US007817109B2

(12) United States Patent
Yoon

(10) Patent No.: US 7,817,109 B2
(45) Date of Patent: Oct. 19, 2010

(54) PLASMA DISPLAY APPARATUS

(75) Inventor: Sang Jin Yoon, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 966 days.

(21) Appl. No.: 11/589,279

(22) Filed: Oct. 30, 2006

(65) Prior Publication Data

US 2007/0097028 A1 May 3, 2007

(30) Foreign Application Priority Data

Oct. 31, 2005 (KR) ..... 10-2005-0103124

(51) Int. Cl.
*G09G 3/28* (2006.01)

(52) U.S. Cl. ..... 345/60; 315/169.4

(58) Field of Classification Search ..... None
See application file for complete search history.

(56) References Cited

U.S. PATENT DOCUMENTS

| | | | | |
|---|---|---|---|---|
| 2001/0011976 | A1* | 8/2001 | Kasahara et al. | 345/60 |
| 2002/0015010 | A1* | 2/2002 | Takahashi | 345/60 |
| 2003/0090488 | A1 | 5/2003 | Yoo | 345/473 |
| 2004/0070590 | A1* | 4/2004 | Lee et al. | 345/690 |
| 2004/0135748 | A1* | 7/2004 | Yoon et al. | 345/60 |
| 2004/0150588 | A1 | 8/2004 | Kang et al. | 345/63 |
| 2004/0155891 | A1* | 8/2004 | Kang | 345/690 |
| 2004/0212559 | A1 | 10/2004 | Lee | 345/60 |
| 2006/0192896 | A1* | 8/2006 | Sawa | 348/607 |

FOREIGN PATENT DOCUMENTS

| | | | |
|---|---|---|---|
| CN | 1604162 | A | 4/2005 |
| CN | 1674071 | A | 9/2005 |
| EP | 1 065 648 | A2 | 1/2001 |
| EP | 1 580 717 | A2 | 9/2005 |

OTHER PUBLICATIONS

European Search Report dated Nov. 19, 2007.
Chinese Office Action dated Mar. 7, 2008.

* cited by examiner

*Primary Examiner*—Bipin Shalwala
*Assistant Examiner*—Daniel Bedell
(74) *Attorney, Agent, or Firm*—Ked & Associates LLP

(57) ABSTRACT

A plasma display panel includes discharges cells that are driven based on unit frames, each of which are partitioned into a plurality of sub-fields. When random noise is present in a unit frame, the number of sub-fields is reduced, to thereby mitigate the effects of the noise.

10 Claims, 10 Drawing Sheets

Fig.5A

Table A1

| SF1 | SF2 | SF3 | SF4 | SF5 | SF6 | SF7 | SF8 | SF9 | SF10 | SF11 | SF12 |
|---|---|---|---|---|---|---|---|---|---|---|---|
| 1 | 2 | 4 | 8 | 16 | 32 | 32 | 32 | 32 | 32 | 32 | 32 |

Table A2

| SF1 | SF2 | SF3 | SF4 | SF5 | SF6 | SF7 | SF8 |
|---|---|---|---|---|---|---|---|
| 1 | 2 | 4 | 8 | 16 | 32 | 32 | 32 |

Table A3

| SF1 | SF2 | SF3 | SF4 | SF5 | SF6 |
|---|---|---|---|---|---|
| 1 | 2 | 4 | 8 | 16 | 32 |

Fig.5B

Table B1

| SF1 | SF2 | SF3 | SF4 | SF5 | SF6 | SF7 | SF8 |
|---|---|---|---|---|---|---|---|
| 1 | 2 | 4 | 8 | 16 | 32 | 64 | 128 |

Table B2

| SF1 | SF2 | SF3 | SF4 | SF5 | SF6 | SF7 |
|---|---|---|---|---|---|---|
| 1 | 2 | 4 | 8 | 16 | 32 | 64 |

Table B3

| SF1 | SF2 | SF3 | SF4 | SF5 | SF6 |
|---|---|---|---|---|---|
| 1 | 2 | 4 | 8 | 16 | 32 |

PLASMA DISPLAY APPARATUS

This Nonprovisional application claims priority under 35 U.S.C. §119(a) on Patent Application No. 10-2005-0103124 filed in Korea on Oct. 31, 2005, the entire contents of which are hereby incorporated by reference.

BACKGROUND

1. Field of the Invention

The present invention relates, in general, to a plasma display apparatus and more particularly, to a plasma display apparatus, which can reduce the generation of heat in a data drive IC, which is incurred by noise.

2. Discussion of Related Art

A Plasma Display Panel (hereinafter, referred to as a "PDP") is an apparatus configured to generate discharge by applying voltage to electrodes disposed in discharge spaces and to display an image including characters and/or graphics by exciting phosphors with plasma generated during the discharge of gas. The PDP is advantageous in that it can be made large, light and thin, can provide a wide viewing angle in all directions, and can implement full colors and high luminance.

In this case, when a video signal is reproduced in a plasma display apparatus, noise may be introduced to the video signal. Such random noise causes a data signal to be distorted. In particular, since the data signal is excessively input to a data drive IC, excessive heat is generated in the data drive IC, leading to damage to an IC in the worst case.

SUMMARY OF THE INVENTION

The present invention has been developed in an effort to provide a plasma display apparatus having the advantage of reducing the generation of heat in the drive IC when random noise is introduced to a picture.

A plasma display apparatus according to a first aspect of the present invention includes a Plasma Display Panel (PDP) having a plurality of discharge cells driven based on unit frames, each of which is divided into a plurality of subfields, wherein when noise is included in the unit frame, the number of subfields constituting the unit frame is controlled.

The number of subfields when noise is included in the unit frame is smaller than that when noise is not included in the unit frame.

A plasma display apparatus according to a second aspect of the present invention includes a plurality of discharge cells, and a Plasma Display Panel (PDP) in which a unit frame is driven with it being divided into a plurality of subfields, wherein when noise is included in the unit frame, a color temperature represented by the unit frame is controlled.

A color temperature when noise is included in the unit frame is lower than a color temperature when noise is not included in the unit frame.

A plasma display apparatus according to a first aspect of the present invention includes a Plasma Display Panel (PDP) having a plurality of discharge cells driven based on unit frames, each of which is divided into a plurality of subfields, wherein when noise is included in the unit frame, the number of sustain pulses constituting the unit frame is controlled.

The number of sustain pulses when noise is included in the unit frame is smaller than the number of sustain pulses when nose is not included in the unit frame.

BRIEF DESCRIPTION OF THE DRAWINGS

FIGS. 5A and 5B show subfield configuration tables of a plasma display apparatus according to a first embodiment of the present invention.

DETAILED DESCRIPTION OF THE INVENTION

The present invention will now be described in detail in connection with specific embodiments with reference to the accompanying drawings.

Figure 1:
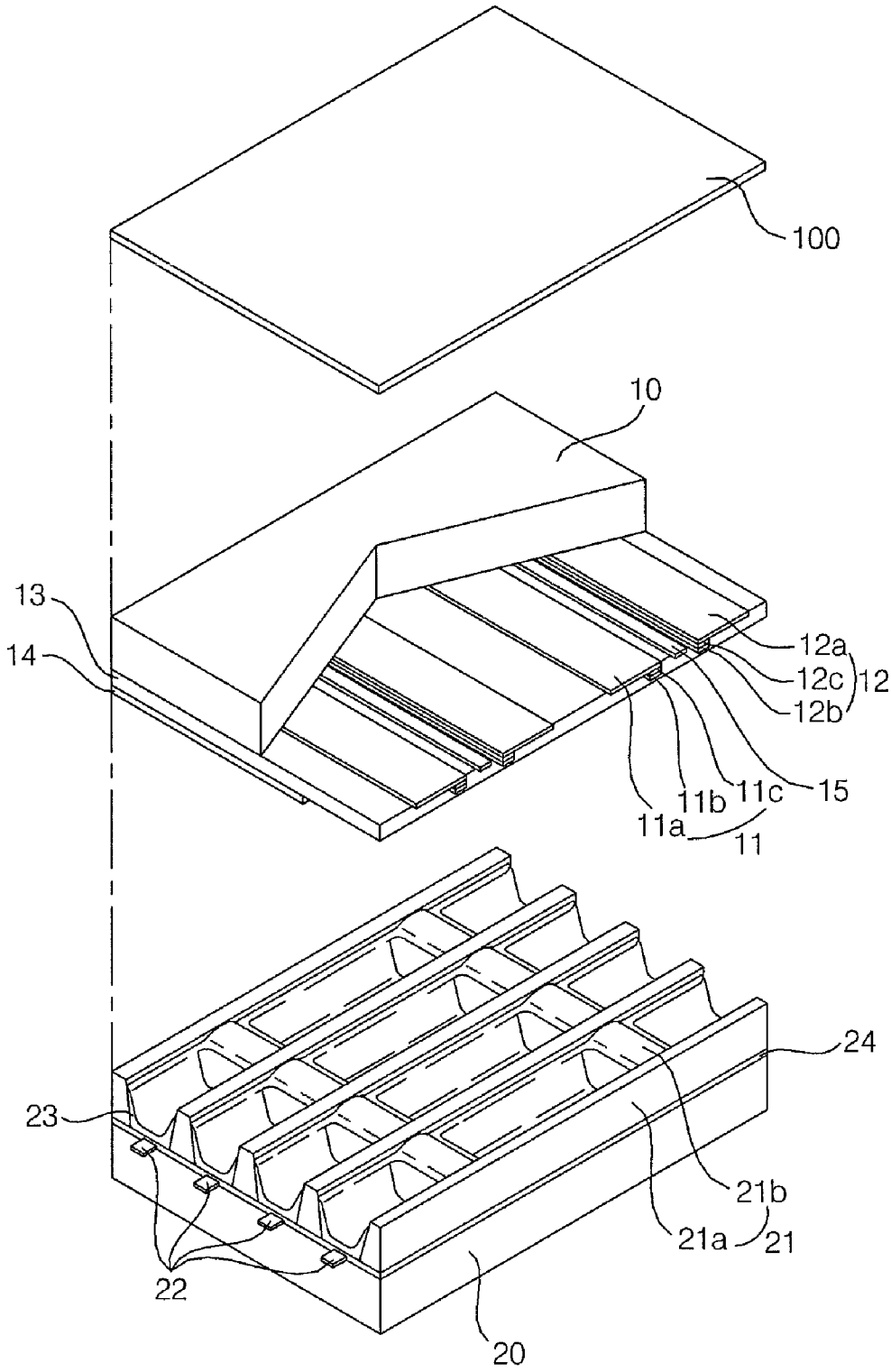
FIG. 1 is a perspective view illustrating the construction of a PDP according to an embodiment of the present invention.

FIG. 1 is a perspective view illustrating the construction of a PDP according to an embodiment of the present invention.

Referring to FIG. 1, the PDP includes a scan electrode 11 and a sustain electrode 12 (i.e., a sustain electrode pair) both of which are formed on a front substrate 10, and address electrodes 22 formed on a rear substrate 20.

The sustain electrode pair 11 and 12 includes transparent electrodes 11*a* and 12*a*, and bus electrodes 11*b* and 12*b*. The transparent electrodes 11*a* and 12*a* are generally formed of Indium-Tin-Oxide (ITO). The bus electrodes 11*b* and 12*b* may be formed using metal, such as silver (Ag) or chrome (Cr), a stack of Cr/copper (Cu)/Cr, or a stack of Cr/aluminum (Al)/Cr. The bus electrodes 11*b* and 12*b* are formed on the transparent electrodes 11*a* and 12*a* and serve to reduce a voltage drop caused by the transparent electrodes 11*a* and 12*a* having a high resistance.

Meanwhile, the sustain electrode pair 11 and 12 according to an embodiment of the present invention may have a structure in which the transparent electrodes 11*a* and 12*a* and the bus electrodes 11*b* and 12*b* are laminated, or include only the bus electrodes 11*b* and 12*b* without the transparent electrodes 11*a* and 12*a*. Such a structure is advantageous in that it can save the manufacturing cost of the panel because it does not require the transparent electrodes 11*a* and 12*a*. The bus electrodes 11*b* and 12*b* used in the structure may also be formed using a variety of materials, such as a photosensitive material, other than the above-mentioned materials.

Black matrices (BM) 15 are arranged between the transparent electrodes 11*a* and 12*a* and the bus electrodes 11*b* and 12*b* of the scan electrode 11 and the sustain electrode 12. The black matrices 15 has a light-shielding function of reducing the reflection of external light generated outside the front substrate 10 by absorbing the external light and a function of improving the purity and contrast of the front substrate 10.

The black matrices 15 according to an embodiment of the present invention are formed in the front substrate 10. Each of the black matrices 15 may include a first black matrix 15 formed at a location at which it is overlapped with a barrier rib 21, and second black matrices 11*c* and 12*c* formed between the transparent electrodes 11*a* and 12*a* and the bus electrodes 11*b* and 12*b*. The first black matrix 15, and the second black matrices 11*c* and 12*c*, which are also referred to as a "black layer" or a "black electrode layer", may be formed at the same time and be connected physically, or may be formed separately and not be connected physically.

In the case where the first black matrix 15 and the second black matrices 11*c* and 12*c* are connected to each other physically, the first black matrix 15 and the second black matrices 11*c* and 12*c* may be formed using the same material. However, in the event that the first black matrix 15 and the second black matrices 11*c* and 12*c* are not connected to each other physically, the first black matrix 15 and the second black matrices 11*c* and 12*c* may be formed using different materials.

An upper dielectric layer 13 and a protection layer 14 are laminated on the front substrate 10 in which the scan electrodes 11 and the sustain electrodes 12 are formed in parallel. Charged particles generated by a discharge are accumulated on the upper dielectric layer 13. The upper dielectric layer 13 can serve to protect the sustain electrode pair 11 and 12. The protection layer 14 serves to protect the upper dielectric layer 13 from sputtering of charged particles generated during the discharge of a gas and also to increase emission efficiency of secondary electrons.

The address electrodes 22 are formed in such a way to cross the scan electrodes 11 and the sustain electrodes 12. Lower dielectric layers 24 and barrier ribs 21 are also formed on the rear substrate 20 in which the address electrodes 22 are formed.

A phosphor layer 23 is formed on the lower dielectric layers 24 and the surfaces of the barrier ribs 21. Each of the barrier ribs 21 includes a longitudinal barrier rib 21*a* and a traverse barrier rib 21*b*, which form a closed form. The barrier ribs 21 can separate discharge cells physically, and can also prevent ultraviolet rays generated by a discharge and a visible ray from leaking to neighboring discharge cells.

As shown in FIG. 1, it is preferred that a filter 100 be formed at the front of the PDP according to an embodiment of the present invention. The filter 100 may include an external light shielding sheet, an Anti-Reflection (AR) sheet, a Near Infrared (NIR) shielding sheet, an Electromagnetic Interference (EMI) shielding sheet, a diffusion sheet, an optical characteristic sheet, and so on.

When the distance between the filter 100 and the panel ranges from 10 to 30 μm, it can effectively block externally incident light and can also effectively emit light generated from the panel to the outside. To protect the panel from pressures from the outside, etc., the adhesive layer may have a thickness of 30 to 120 μm.

An adhesive layer for adhering the filter 100 and the panel may be formed between the filter 100 and the panel.

An embodiment of the present invention may be applied to not only the structure of the barrier ribs 21 shown in FIG. 1, but also the structure of barrier ribs having a variety of shapes. For example, an embodiment of the present invention may be applied to a differential type barrier rib structure in which the longitudinal barrier rib 21*a* and the traverse barrier rib 21*b* have different height, a channel type barrier rib structure in which a channel that can be used as an exhaust passage is formed in at least one of the longitudinal barrier rib 21*a* and the traverse barrier rib 21*b*, a hollow type barrier rib structure in which a hollow is formed in at least one of the longitudinal barrier rib 21*a* and the traverse barrier rib 21*b*.

In the differential type barrier rib structure, it is preferred that the traverse barrier rib 21*b* have a height "h" higher than that of the longitudinal barrier rib 21*a*. In the channel type barrier rib structure or the hollow type barrier rib structure, it is preferred that a channel or a hollow be formed in the traverse barrier rib 21*b*.

Meanwhile, in an embodiment of the present invention, it has been shown and described that the R, G, and B discharge cells are arranged on the same line. However, the R, G, and B discharge cells may be arranged in different forms. For example, the R, G, and B discharge cells may have a delta type arrangement in which they are arranged in a triangle. Furthermore, the discharge cells may be arranged in a variety of forms, such as square, pentagon and hexagon.

The phosphor layer is emitted with ultraviolet rays generated during the discharge of a gas to generate any one visible ray of red (R), green (G) and blue (B). Discharge spaces provided between the upper/rear substrates 10 and 20 and the barrier ribs 21 are injected with a mixed inert gas, such as He+Xe, Ne+Xe or He+Ne+Xe.

Figure 2:
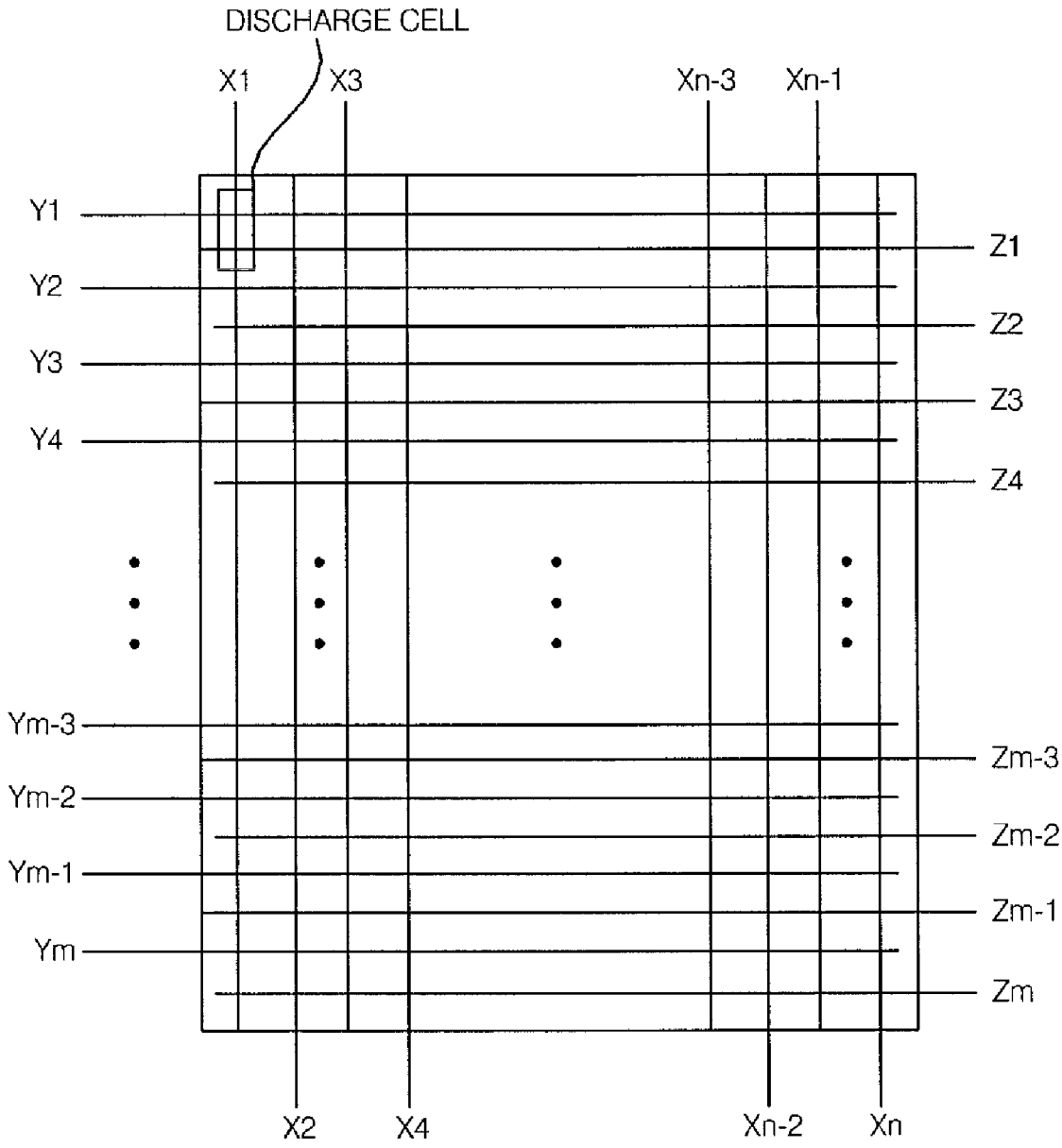
FIG. 2 is a view illustrating an embodiment of electrode arrangements of the PDP.

FIG. 2 is a view illustrating an embodiment of electrode arrangements of the PDP. It is preferred that a plurality of discharge cells constituting the PDP be arranged in matrix form, as illustrated in FIG. 2. The plurality of discharge cells are respectively disposed at the intersections of scan electrode lines Y1 to Ym, sustain electrodes lines Z1 to Zm, and address electrodes lines X1 to Xn. The scan electrode lines Y1 to Ym may be driven sequentially or simultaneously. The sustain electrode lines Z1 to Zm may be driven at the same time. The address electrode lines X1 to Xn may be driven with them being divided into even-numbered lines and odd-numbered lines, or may be driven sequentially.

The electrode arrangement shown in FIG. 2 is only an embodiment of the electrode arrangements of the PDP according to an embodiment of the present invention. Thus, the present invention is not limited to the electrode arrangements and the driving method of the PDP, as illustrated in FIG. 2. For example, the present invention may be applied to a dual scan method in which two of the scan electrode lines Y1 to Ym are driven at the same time. Furthermore, the address electrode lines X1 to Xn may be driven with them being divided into upper and lower parts on the basis of the center of the panel.

Figure 3:
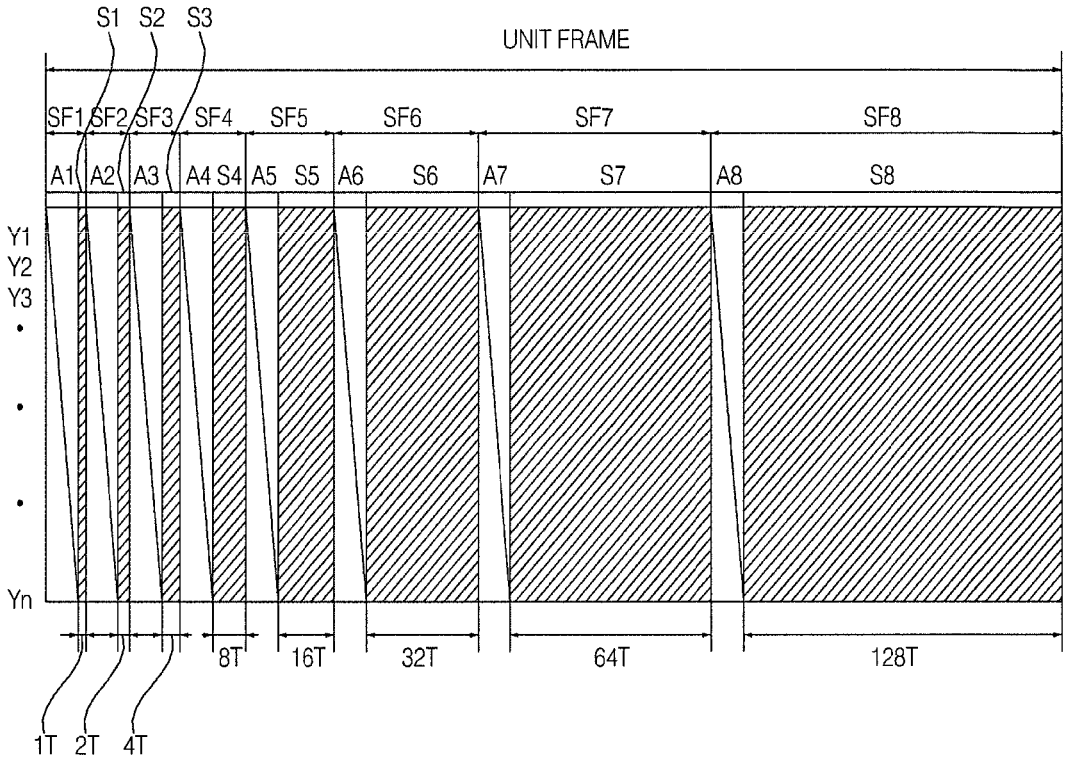
FIG. 3 is a timing diagram illustrating a method of driving one frame of an image with no noise with it being time-divided into a plurality of subfields in a plasma display apparatus.

FIG. 3 is a view illustrating the configuration of a unit frame when there is no noise, that is, a timing diagram illustrating a method of driving one frame of an image with no noise with it being time-divided into a plurality of subfields in a plasma display apparatus. A unit frame may be divided into a predetermined number (for example, eight subfields SF1, . . . , SF8) in order to realize time-divided gray level display. Each of the subfields SF1, . . . , SF8 is divided into a reset period (not shown), address periods A1, . . . , A8, and sustain periods S1, . . . , S8. Alternatively, the unit frame may include twelve subfields. However, a case in which the unit frame includes eight subfields will be described as an example.

The reset period may be omitted from at least one of the plurality of subfields. For example, the reset period may exist only in the first subfield, or may exist only in a subfield approximately between the first subfield and the whole subfields.

In each of the address periods A1, . . . , A8, an address signal is applied to address electrodes X, and scan signals corresponding to the respective scan electrodes Y are sequentially applied to the address electrodes X.

In each of the sustain periods S1, . . . , S8, a sustain signal is alternately applied to the scan electrodes Y and a sustain electrodes Z. Accordingly, a sustain discharge is generated in discharge cells on which wall charges are formed in the address periods A1, . . . , A8.

The luminance of the PDP is proportional to the number of sustain discharge pulses within the sustain periods S1, . . . , S8 occupied in the unit frame. In the case where one frame forming 1 image is represented by eight subfields and 256 gray levels, a different number of sustain signals may be sequentially allocated to the respective subfields in the ratio of 1, 2, 4, 8, 16, 32, 64, and 128. For example, to obtain the luminance of 133 gray levels, a sustain discharge can be generated by addressing cells during the subfield1 period, the subfield3 period, and the subfield8 period.

The number of sustain discharges allocated to the respective subfields may be variably decided depending on the weights of subfields based on an Automatic Power Control (APC) step. That is, an example in which one frame is divided into eight subfields has been described with reference to FIG. 3. However, the present invention is not limited to the above example, but the number of subfields forming one frame may be varied depending on design specifications. For example, the PDP can be driven by dividing one frame into eight or more subfields, such as 12 or 16 subfields.

Furthermore, the number of sustain discharges allocated to each subfield may be changed in various ways by taking a gamma characteristic or a panel characteristic into consideration. For example, the degree of a gray level allocated to the subfield4 can be lowered from 8 to 6, and the degree of a gray level allocated to the subfield6 can be lowered from 32 to 34.

Figure 4:
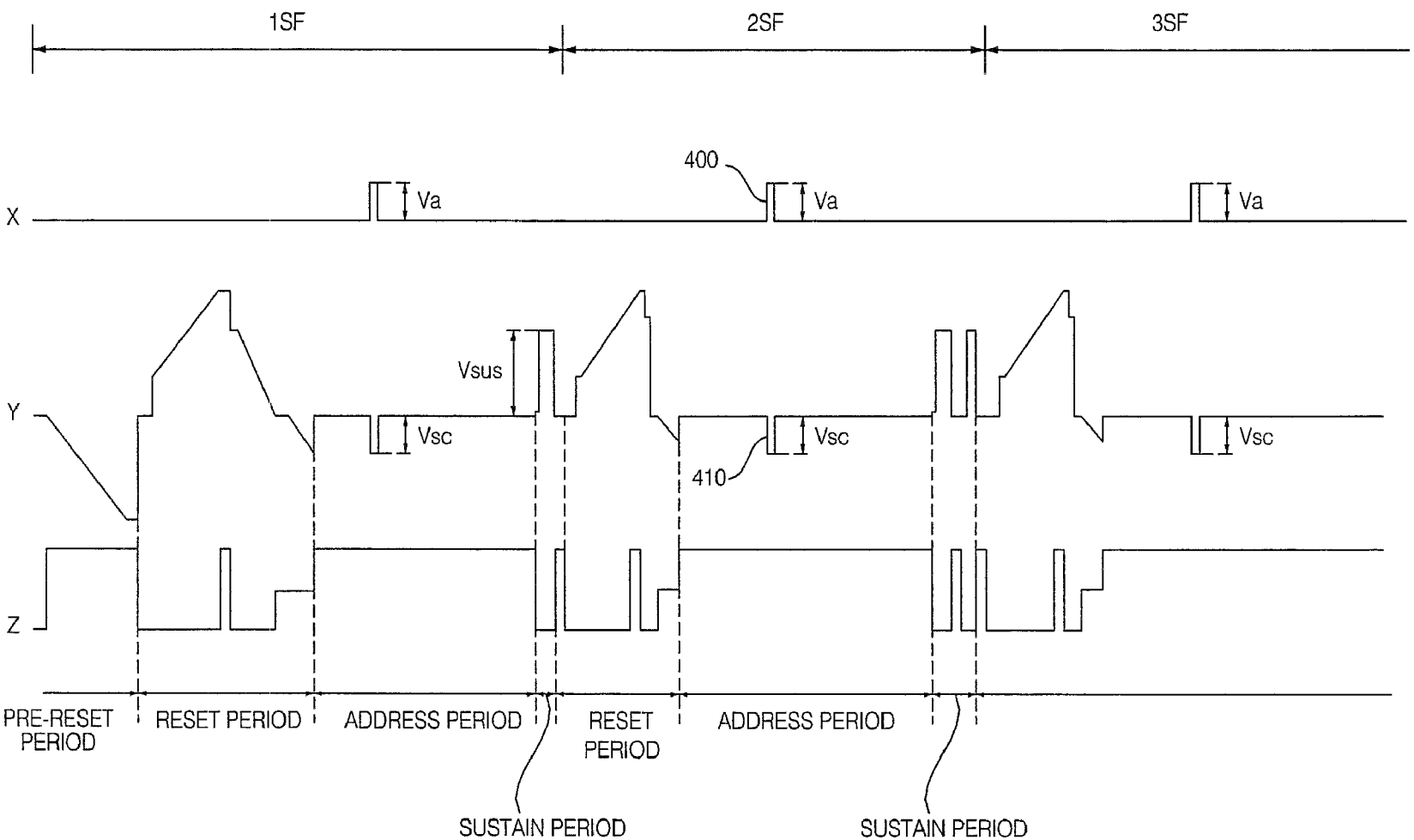
FIG. 4 is a timing diagram illustrating an embodiment of driving signals for driving the PDP when there is no noise in a unit frame.

FIG. 4 is a timing diagram illustrating an embodiment of driving signals for driving the PDP when there is no noise in a unit frame.

Each subfield includes a pre-reset period for forming positive wall charges on the scan electrodes Y and negative wall charges on the sustain electrodes Z, a reset period for initializing discharge cells of the whole screen by employing wall charge distributions formed by the pre-reset period, an address period for selecting discharge cells, and a sustain period for sustaining the discharge of selected discharge cells.

The reset period includes a setup period and a set-down period. In the setup period, a ramp-up waveform Ramp-up is applied to the entire scan electrodes at the same time. Thus, a minute discharge is generated in the entire discharge cells and wall charges are generated accordingly. In the set-down period, a ramp-down waveform Ramp-down, which falls from a positive voltage lower than a peak voltage of the ramp-up waveform, is applied to the entire scan electrodes Y at the same time. Accordingly, an erase discharge is generated in the entire discharge cells, thereby erasing unnecessary charges from the wall charges generated by the set-up discharge and spatial charges.

In the address period, a scan signal 410 having a negative scan voltage Vsc is sequentially applied to the scan electrodes Y, and an address signal 400 having a positive address voltage Va is applied to the address electrodes X so that the address signal 400 is overlapped with the scan signal. Therefore, an address discharge is generated due to a voltage difference between the scan signal 410 and the data signal 400 and a wall voltage generated during the reset period, so that cells are selected. Meanwhile, during the set-down period and the address period, a signal to sustain a sustain voltage is applied to the sustain electrodes Z.

In the sustain period, a sustain signal is alternately applied to the scan electrodes Y and the sustain electrodes Z. Accordingly, a sustain discharge occurs between the scan electrodes and the sustain electrodes in a surface discharge fashion.

FIGS. 5A and 5B show subfield configuration tables of a plasma display apparatus according to a first embodiment of the present invention.

The plasma display apparatus according to an embodiment of the present invention includes a plurality of discharge cells, and a PDP in which a unit frame is driven with it being divided into a plurality of subfields. The plasma display apparatus checks whether noise is included in the unit frame, and controls an output gain value of a picture data when noise is included in the unit frame.

In general, when there is no noise, the output gain value is 1, but when there is noise in the unit frame, the output gain value is controlled to become a value less than 1. Whether noise has occurred can be determined by a method employing a difference in the gray level between corresponding cells by means of comparison with a previous frame.

When the output gain value is 1 or less, the number of subfields is reduced, a color temperature and a color coordinate is controlled, or the number of sustain pulses is adjusted.

Referring to FIG. 5A, the plasma display apparatus according to a first embodiment of the present invention includes a plurality of discharge cells, and a PDP in which a unit frame is driven with it being divided into a plurality of subfields. When noise is included in the unit frame, the number of subfields constituting the unit frame is adjusted.

The number of subfields when noise is included in the unit frame is controlled to be smaller than the number of subfields when noise is not included in the unit frame.

That is, when noise is included in the unit frame, the gain value is controlled such that the number of subfields of the unit frame is decreased.

If the number of subfields decreases, the number of gray levels that can be represented decreases. In other words, when noise occurs, the screen is represented darker by reducing the number of gray levels that can be represented, thereby reducing the influence of noise.

There is shown, in FIG. 5A, a subfield table in which the unit frame is driven with it being divided into twelve subfields in order to represent 256 gray levels. Weights of the subfields are illustrated under corresponding subfields.

Referring to FIG. 5A, if there is no noise, the unit frame is driven with it being divided into twelve subfields, as illustrated in Table A1.

When there is noise in the frame, the number of subfields is reduced, as illustrated in Table A2 or Table A3. In other words, the unit frame is driven by only eight subfields or six subfields.

In the case where the frame is driven by the eight subfields, the subfields are constructed, as illustrated in Table A2, and the maximum 128 gray levels can be represented. In this case, weights from the subfield 1 to the subfield 8 are the same as when there is no noise, and the remaining subfields 9 to 128 are omitted. However, the weights may be constructed differently from when there is no noise.

If the frame is driven by six subfields, the subfields are constructed as illustrated in Table A3, and the maximum 64 gray levels can be represented. Even in this case, weights from the subfield 1 to the subfield 6 are the same as when there is no noise, and the remaining subfields 7 to 128 are omitted. However, the weights may be constructed differently from when there is no noise.

FIG. 5B illustrates a subfield table in which the unit frame is driven with it being divided into eight subfields, thus representing 256 gray levels. Weights of the subfields are illustrated under corresponding subfields.

Referring to FIG. 5B, when there is no noise, the unit frame is driven with it being divided into eight subfields, as illustrated in Table B1. When there is noise included in the frame, the number of subfields is decreased, as illustrated in Table B2 or Table B3. That is, the unit frame is driven by only seven subfields or six subfields.

In this case, in the case where the unit frame is driven by seven subfields, the subfields are constructed as in Table B2, and the maximum 128 gray levels can be represented. In this case, weights from the subfields 1 to 7 are the same as when there is no noise, and the remaining subfields 8 to 128 may be omitted.

In the case where the unit frame is driven with it being divided into six subfields, the subfields are constructed as in Table B3, and the maximum 64 gray levels can be represented. Even in this case, weights from the subfields 1 to 6 are the same as when there is no noise, and the remaining subfields 7 to 128 may be omitted.

Figure 6A:
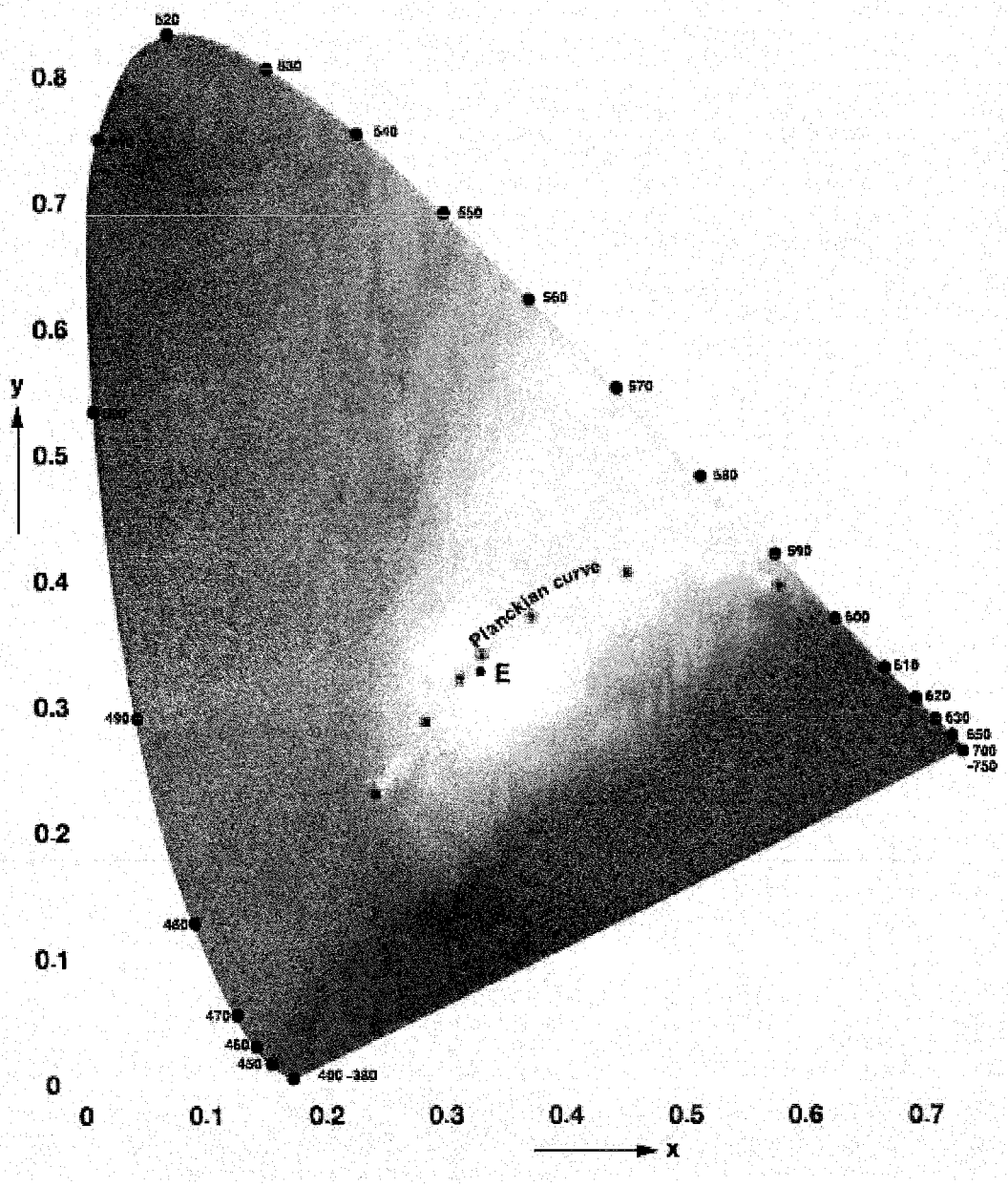
FIGS. 6A and 6B are graphs illustrating color coordinates and color temperatures of a plasma display apparatus according to a second embodiment of the present invention.
Figure 6B:
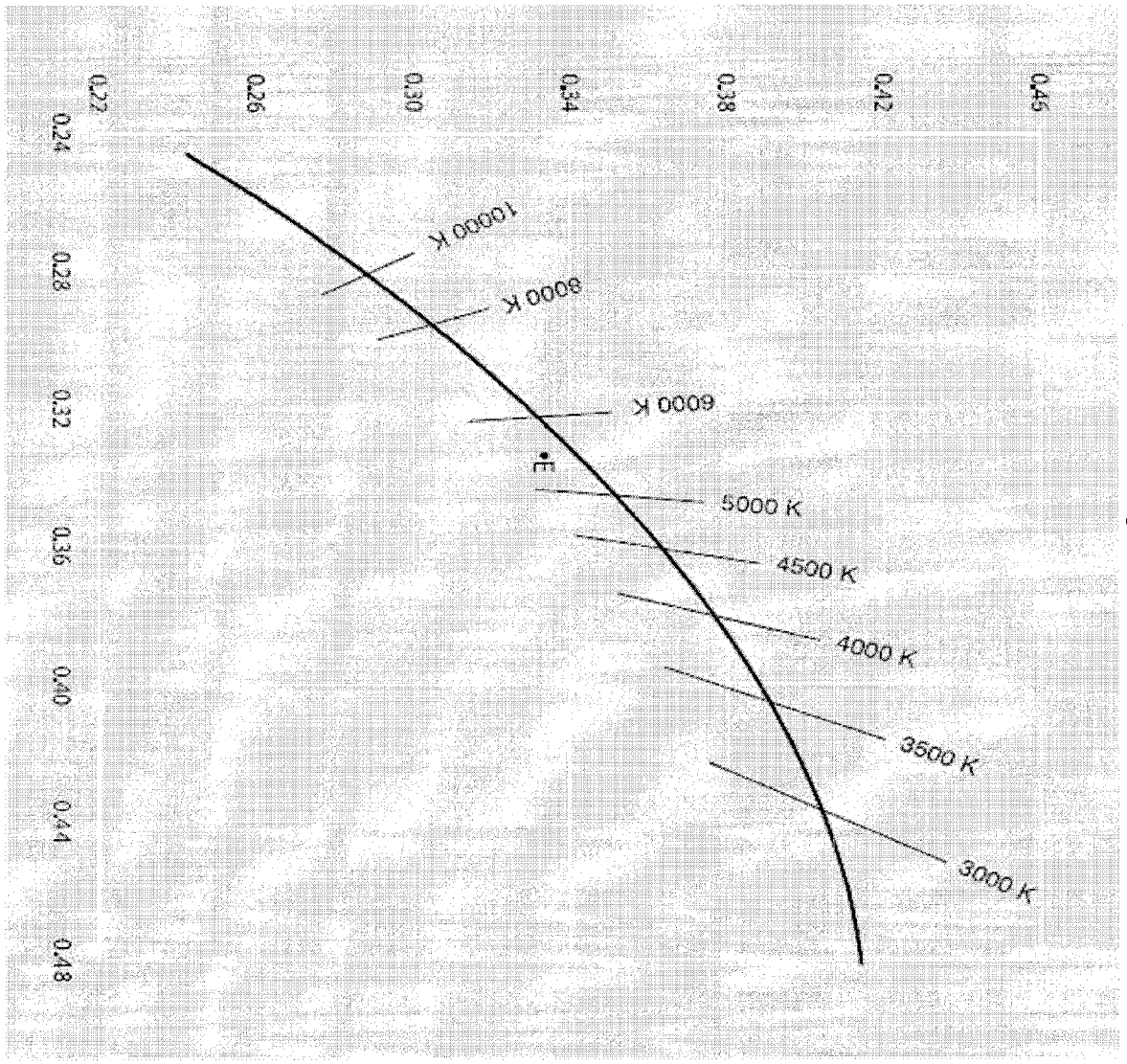

FIGS. 6A and 6B are graphs illustrating color coordinates and color temperatures of a plasma display apparatus according to a second embodiment of the present invention.

Referring to FIGS. 6A and 6B, the plasma display apparatus according to a second embodiment of the present invention includes a plurality of discharge cells, and a PDP in which a unit frame is driven with it being divided into a plurality of subfields. When noise is included in a unit frame, a color temperature representing the unit frame is controlled.

In this case, color temperatures when noise is included in the unit frame are lower than that when noise is not included in the unit.

FIG. 6A is a graph showing color coordinates, and FIG. 6B is a graph showing color temperatures.

Referring to FIGS. 6A and 6B, the color temperature is moved along a line called a "Planckian curve" in the color coordinate. If the temperature rises, a blue spectrum becomes strong and a red spectrum becomes weak. That is, as the color temperature rises, a cool light color appears, and as the color temperature falls, a warm light color appears.

In other words, in the second embodiment of the present invention, a color coordinate value when noise is included in the unit frame is moved toward the red region compared with a color coordinate value when noise is not included in the unit frame.

In an embodiment in which when there is noise in the unit frame, the color temperature of an output screen is lowered, a discharge is generated weakly in blue phosphors or discharge is generated more strongly in red phosphors, compared with when there is no noise. However, the present invention is not limited to the above method, and the color temperature may be lowered.

Figure 7A:
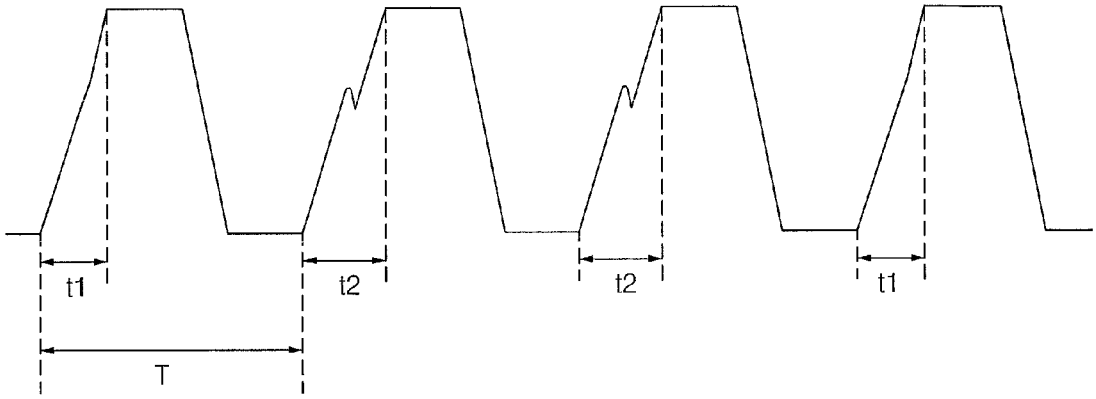
FIGS. 7A and 7B illustrate waveforms of a sustain pulse of a plasma display apparatus according to a third embodiment of the present invention.
Figure 7B:
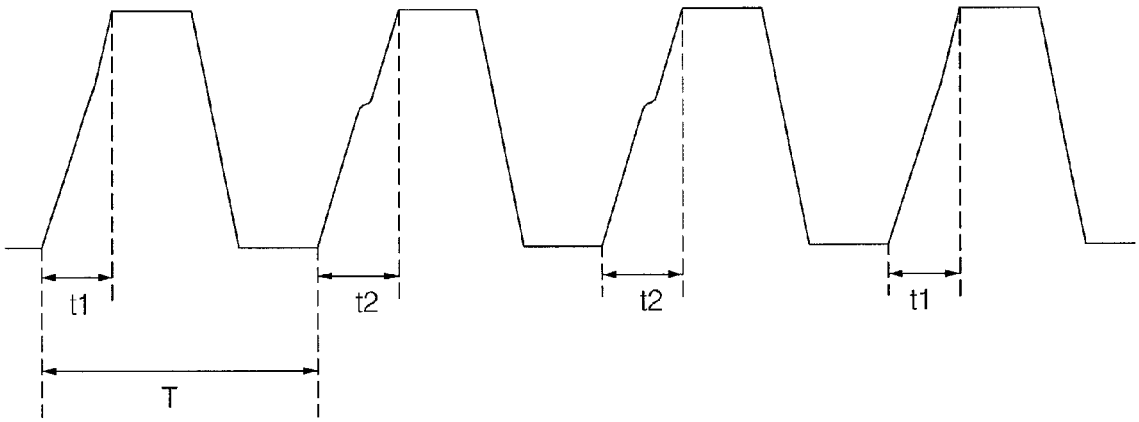

FIGS. 7A and 7B illustrate waveforms of a sustain pulse of a plasma display apparatus according to a third embodiment of the present invention.

The plasma display apparatus according to a third embodiment of the present invention includes a plurality of discharge cells, and a PDP in which a unit frame is driven with it being divided into a plurality of subfields. When noise is included in a unit frame, the number of sustain pulses constituting the unit frame is controlled.

In this case, the number of sustain pulses when noise is included in the unit frame becomes smaller than that when noise is not included in the unit frame.

Furthermore, a total number of sustain pulses applied to the unit frame is set smaller than those when there is no noise, so that they are allocated in proportion to the weights of the whole subfields. As the number of sustain pulses decreases, luminance will become low compared with when there is no noise. In other words, the influence of noise can be minimized by lowering the luminance of the unit frame in which noise has occurred.

Alternatively, the number of subfields is less allocated as many as the number of sustain pulses, which is reduced as in the first embodiment. For example, when noise is included in the unit frame, the sustain pulse may be omitted from three or six subfields. When noise is included in the unit frame, a rising time (ER_UP time) of the sustain pulse may be set to be different from a rising time (ER_UP time) of the sustain pulse of the unit frame in which noise is not included.

Referring to FIGS. 7A and 7B, when noise is included in the unit frame, a cycle T of a sustain pulse may be set in the range of 7 to 5.4 μs.

A rising time t1 or t2 of the sustain pulse may be set in the range of approximately 540 to 700 ns.

A waveform of the sustain pulse may rise at a two-step slant, as illustrated in the first waveform of FIG. 7A.

The waveform of the sustain pulse may be constructed so that it rises up to a specific voltage and then rises up to a sustain voltage, as illustrated in the second waveform of FIG. 7B, or it rises up to a specific voltage, falls a little, and then rises up to the sustain voltage, as illustrated in the second waveform of FIG. 7A, by using the output of an energy recovery circuit.

The sustain waveform may employ a combination of the above-mentioned several waveforms.

Figure 8:
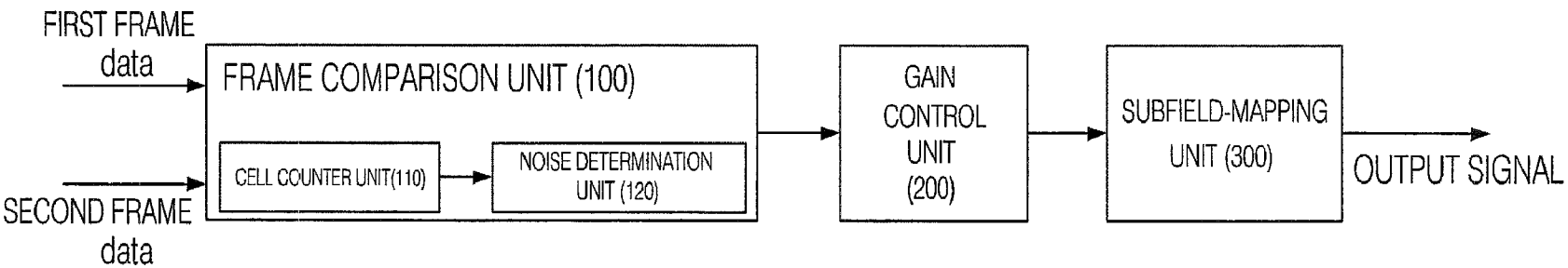
FIG. 8 is a block diagram of a plasma display apparatus according to an embodiment of the present invention.

FIG. 8 is a block diagram of a plasma display apparatus according to an embodiment of the present invention.

The plasma display apparatus according to an embodiment of the present invention includes a frame comparison unit 100 configured to check whether random noise exists in a first frame, and a gain control unit 200 configured to control the gain value of the first frame according to the check result.

The first frame may include one frame of an image output by the plasma display apparatus. In the present embodiment, the first frame refers to a frame having a picture data that is now to be displayed.

The frame comparison unit 100 compares two frames that are consecutive in time in order to check whether there is random noise in the frames. Accordingly, random noise is checked by comparing the first frame, and a second frame consecutive to the first frame. The second frame may be a frame anterior to the first frame, or a frame posterior to the first frame.

In this case, the plasma display apparatus may further include frame memory configured to store therein data of the second frame.

If the second frame is a frame anterior to the first frame, the data of the second frame is stored in the frame memory after the second frame is displayed, and the second frame is then compared with the first frame.

If the second frame is a frame posterior to the first frame, the data of the second frame is previously stored in the frame memory, and is then compared with the first frame.

In the case where random noise is inserted into a picture data, thus affecting the picture data, a picture data of a frame including random noise has a gray level significantly different from that of a common picture data not having noise.

That is, frames anterior to and posterior to a frame having the random noise and the frame not having the random noise are significantly different in the number of cells having a gray level difference. In this difference, a gray level is changed more significantly than gray levels of a cell of a corresponding location since an image is moved from a motion image.

Accordingly, the frame comparison unit 100 compares gray level differences of the cell of the first frame and the cell of the second frame in order to check whether there is random noise. In this case, the cell of the first frame and the cell of the second frame are cells of corresponding locations. In the case of a motion image, a gray level difference can be determined by taking a direction along which the image is moved, a moving distance of the image, etc. in the previous frame and the current frame into consideration.

However, even in this motion image, a gray level difference change of an image between frames is not great compared with a frame having noise. Thus, it is possible to determine whether random noise exists by comparing only cells of corresponding locations without considering the movement of the image.

The frame comparison unit 100 includes a cell counter unit 110 and a noise determination unit 120.

The cell counter unit 110 measures the number of cells having a first reference value.

The cell counter unit 110 compares image information of the first frame and image information of the second frame on a cell basis. The cell counter unit 110 compares gray level values of the cell of the first frame, and a cell of a location corresponding to the second frame in order to find a difference in the gray level value.

The cell counter unit 110 sets a first reference value Gray_threshold of the gray level difference, and counts how many cells having a gray level difference higher than the first reference value are there.

When noise is introduced, by comparing a picture data before noise is introduced and the picture data after noise is introduced, the gray level difference will have a value higher than a range value in which it is substantially the same screen.

Accordingly, the first reference value must be set higher than a gray level difference between cells of two consecutive frames so that they can be recognized to be substantially the same screen.

In order to meet the conditions, the first reference value may be set to a value ranging from 70 to 85% of a total number of gray levels. In the case of 256 gray levels, the first reference value may be set to a specific gray level value between 180 to 217 gray levels, which falls within the range.

In other words, in the case of 256 gray levels, it is determined that there is distortion of signal in a corresponding cell when a difference between a gray level value of the first frame and a gray level value of the second frame is a specific gray level value (for example, 190) or more between the 180 gray levels and the 217 gray level, as a result of comparing the two frames consecutive in a specific cell.

In this case, the sensitivity of noise determination can be controlled depending on to which value within the reference range is the first reference value set.

If the first reference value is lower than 70% of a total number of gray levels, there is a problem in which it is determined that noise has occurred even in motion images having lots of movement.

If the first reference value is higher than 85% of a total number of gray levels, noise may not be detected despite it has occurred.

However, if it is determined that noise has introduced because the distortion of gray levels exists in one cell as described above, error may occur. Thus, it is necessary to compare and determine cells on the basis of the whole screen. To this end, the cell counter 110 first check cells of the whole screen and sums the number of cells exhibiting a gray level difference higher than the first reference value.

After all the cells are compared, the noise determination unit 120 determines that random noise exists when the resulting value of the cell counter unit 110 is higher than a second reference value.

The noise determination unit 120 sets the number of cells, which becomes a basis for determining whether an image is one to which noise has been introduced, the second reference value, and determines that noise has been introduced to the image when the number of cells calculated in the cell counter unit 110 is higher than the second reference value.

Furthermore, the first reference value and the second reference value correspond to comparison between frames, and are thus recognized within a very short period of time. Accordingly, it is necessary to set margin high in motion images rather than relatively in the case of comparison between still image.

The noise determination unit 120 sets the second reference value, which is a basis for determining whether noise has been introduced to an image on a frame basis depending on how many cells with a gray level difference higher than the first reference value are there in one frame. The second reference value is also set depending to what % of the entire cells does one cell belong in consideration of the sensitivity of sight of human and the emission time of the screen.

The second reference value may be set in the range of, for example, 45 to 55% of the whole cells.

In a similar way, the sensitivity of noise determination can be controlled depending on to what value within the range is the value of the second reference value set.

The gain control unit 200 sets the gain value to 1 when there is no random noise, and sets the gain value to a positive number less than 1 when there is random noise.

The gain control unit 200 corrects a gray level data of each cell constituting the first frame based on the gain value. A total number of gray levels is proportional to the gain value.

That is, if the gain value is lowered, the gray level of the whole screen is lowered. In other words, in the case of 256 gray levels, if the gain value is set to 0.5, only 128 gray levels can be represented. Accordingly, if the gain value is properly adjusted, if needed, the number of subfields necessary to represent the gray level number becomes small.

In the case of a noise screen, the whole gray level can be lowered by lowering the gain within a very short period of time as described above. The noise screen is represented dark within a very short period of time so that the distortion of the screen cannot be felt visually.

The plasma display apparatus further includes a subfield-mapping unit 300 configured to vary the number of subfields constituting the first frame according to the gain value.

The subfield-mapping unit 300 maps subfields in such a manner that as the gain value lowers, the number of subfields constituting the first frame decreases. Since the number of gray levels that can be represented reduces as described above, the number of subfields for representing the gray levels can be decreased. The subfield-mapping unit 300, which reduces the number of subfields in order to represent gray levels as described above, newly produces the construction of subfields that can represent each gray level.

In general, in the case of 256 gray levels, the gray levels are represented using eight or twelve subfields. If the whole gray levels do not become 256 even after the gain value is adjusted, the number of subfields can be reduced. If twelve subfields are required to represent 256 gray levels, only eight or nine subfields may be required to represent 128 gray levels. Thus, the number of subfields can be reduced. That is, the subfield mapping tables may be differently applied according to the gain value.

Accordingly, the subfield-mapping unit 300 maps subfields so that the number of subfields is less when the gain value is 1 or less than when the gain value is 1.

The noise screen has a less number of gray levels, thereby reducing the number of subfields. Accordingly, there are advantages in that the whole sustain period can be curtained, and the number of data pulses can be reduced. By reducing the number of data pulses as described above, the amount of generated heat of the drive IC can be reduced. However, the plasma display apparatus according to the present invention is not limited toe the above embodiment, but may be implemented in various ways.

Figure 9:
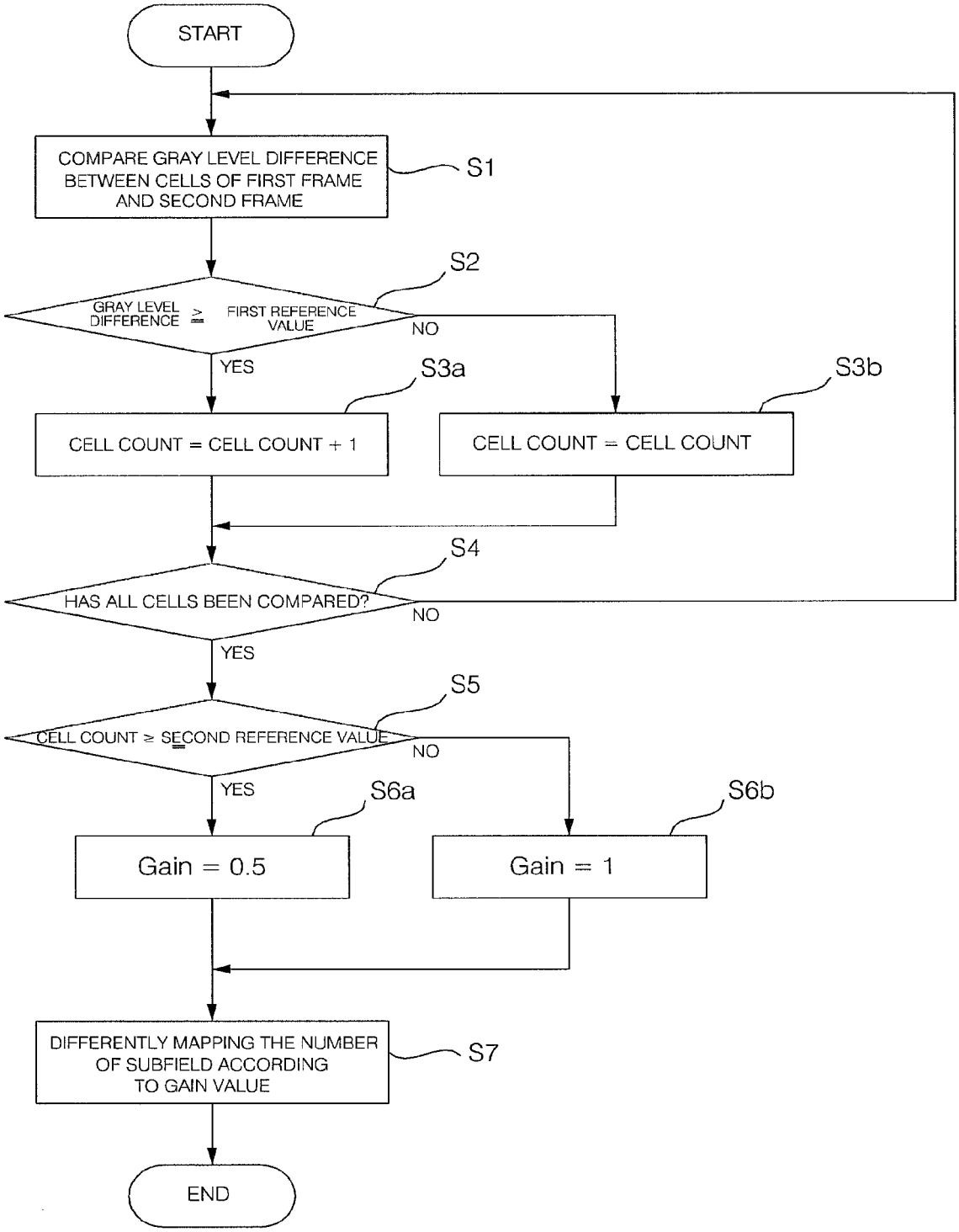
FIG. 9 is a flowchart illustrating a method of driving the plasma display apparatus according to an embodiment of the present invention.

The operation of the plasma display apparatus constructed above according to an embodiment of the present invention will be described with reference to FIG. 9. FIG. 9 is a flowchart illustrating a method of driving the plasma display apparatus according to an embodiment of the present invention.

If a video signal of a first frame and a second frame is input to the frame comparison unit 100, the cell counter unit 110 compares a gray level difference between cells of the first frame and the second frame at step S1.

If the gray level difference is higher than a first reference value, the cell counter unit 110 increases a cell count by 1 at steps S2 and S3*a*.

The cell count is a parameter indicating the number of cells having a given gray level difference or more.

If the gray level difference is less than the first reference value, the process proceeds to a next step without changing the cell count at steps S2 and S3*b*.

It is determined whether the steps from the comparison step S1 to the steps S3*a* and S3*b* have been performed on all cells belonging to a current frame. If there are cells that have not been compared, the comparison step is repeated at step S4.

After the comparison step is performed on all the cells, a cell count value is transmitted to the noise determination unit 120.

The noise determination unit 120 determines whether the cell count is higher than a second reference value at step S5.

If it is determined that the cell count is higher than the second reference value, that is, if it is determined that noise exists in the input video signal, the gain control unit 200 sets a gain value to a value less than 1 at step S6*a*.

If the gain value is too low, the screen looks too dark, and visually distorted screen can be seen. Accordingly, the gain value must be set to an appropriate value. In the present embodiment, the gain value is set to 0.5 in which no visual difficulty exists by processing noise, but not limited to the above.

If it is determined that the cell count is less than the second reference value, there may be a difference of a minute signal not noise although there is a gray level difference between cells by some degree, which is not a problem in terms of vision if noise is not severe. Thus, the gain value remains intact. That is, the gain control unit 200 sets the gain value to 1.

The subfield-mapping unit 300 maps the number of subfields differently according to the gain value adjusted as described above at step S7.

That is, if a combination of 12 subfields is mapped when the gain value is less than 1, the number of subfields is reduced to 3 to 4 when the gain value is 0.5.

This is because as a total number of represented gray levels is lowered by the gain value, the lowered number of gray levels can be represented using a less number of subfields.

The subfield-mapping unit 300 may have two or more subfield mapping tables for the purpose of the above operation.

As the number of subfields of a frame with noise is reduced, the gray level number can be represented low. By decreasing the frequency of signals input to the drive IC, a phenomenon in which heat is generated in the drive IC due to noise can be reduced.

While the plasma display apparatus according to an embodiment of the present invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display apparatus, comprising:

a Plasma Display Panel having a plurality of discharge cells, a driver circuit to drive the discharge cells based on a unit frame which is divided into a plurality of subfields; and a detector to detect whether random noise is in the unit frame, wherein, when detected random noise is included in the unit frame, a number of subfields in the unit frame is controlled, the number of subfields in the unit frame that includes detected random noise is smaller than when random noise is not detected in the unit frame, wherein a type of random noise detected by the detector is different from distortion generated by image motion, the apparatus further comprising:

a controller to set an output gain value of image data in the unit frame to a first value when no random noise is detected in the unit frame, and to set the output gain value of the image data in the unit frame to a second value when random noise is detected in the unit frame.

2. The plasma display apparatus of claim 1, wherein the number of subfields when random noise is included in the unit frame is 1 to 6 which is smaller than that when random noise is not included in the unit frame.

3. The plasma display apparatus of claim 1, wherein the number of subfields when random noise is included in the unit frame is 6 to 8.

4. The plasma display apparatus of claim 2, wherein if random noise is included in the unit frame, one to six subfields beginning from a subfield having a highest weight of a unit frame in which random noise is not included are omitted.

5. The plasma display apparatus of claim 1, wherein a number of gray levels that can be represented when random noise is included in the unit frame is half a number of gray levels that can be represented when random noise is not included in the unit frame.

6. The plasma display apparatus of claim 1, wherein the first value is greater than the second value.

7. The plasma display apparatus of claim 6, wherein the second value is less than one.

8. The plasma display apparatus of claim 7, wherein setting the second value to less than one reduces the number of subfields used to display the image data in the unit frame relative to the number of subfields used to display the image data when no random noise is detected in the unit frame.

9. The plasma display apparatus of claim 8, wherein reducing the number of subfields causes the image data to be appear darker than display of the image data when no random noise is detected in the unit frame.

10. The plasma display apparatus of claim 9, wherein the controller applies a different arrangement of weights to the subfields when the unit frame includes random noise, compared with weights applied when no random noise is detected in the unit frame.

* * * * *